US009517176B2

(12) United States Patent
Lach

(10) Patent No.: US 9,517,176 B2
(45) Date of Patent: Dec. 13, 2016

(54) CROSS ACTION CHEST COMPRESSION APPARATUS FOR CARDIAC ARREST

(76) Inventor: Thomas E. Lach, Columbus, OH (US)

( * ) Notice: Subject to any disclaimer, the term of this patent is extended or adjusted under 35 U.S.C. 154(b) by 3638 days.

(21) Appl. No.: 12/004,004

(22) Filed: Dec. 19, 2007

(65) Prior Publication Data

US 2009/0093741 A1 Apr. 9, 2009

(51) Int. Cl.
*A61H 31/02* (2006.01)
*A61H 31/00* (2006.01)

(52) U.S. Cl.
CPC ..... *A61H 31/005* (2013.01); *A61H 31/007* (2013.01); *A61H 31/008* (2013.01); *A61H 2031/001* (2013.01); *A61H 2031/002* (2013.01); *A61H 2031/003* (2013.01); *A61H 2201/018* (2013.01); *A61H 2201/5007* (2013.01); *A61H 2201/5043* (2013.01); *A61H 2201/5048* (2013.01); *A61H 2201/5061* (2013.01); *A61H 2230/04* (2013.01)

(58) Field of Classification Search
CPC .. A61H 31/005; A61H 31/007; A61H 31/008; A61H 2230/04; A61H 2031/002; A61H 2031/001; A61H 2201/5061; A61H 2201/5048; A61H 2201/5043; A61H 2201/5007; A61H 2031/003; A61H 2201/018
USPC ..... 601/41, 42, 43, 44, 107, 108, 134, 135; 606/201, 202
See application file for complete search history.

(56) References Cited

U.S. PATENT DOCUMENTS 651,962 A 6/1900 Boghean
1,399,034 A 12/1921 Taplin
2,071,215 A 2/1937 Petersen
2,699,163 A 1/1955 Engstrom
2,754,817 A 7/1956 Nemeth
2,708,222 A 2/1957 Polzin et al.
2,853,998 A 9/1958 Emerson
2,899,955 A 8/1959 Huxley
3,042,024 A 7/1962 Mendelson
3,120,228 A 2/1964 Huxley
3,368,550 A 2/1968 Glascock
(Continued)

FOREIGN PATENT DOCUMENTS

DE 624118 1/1936

OTHER PUBLICATIONS

NASA Tech Briefs—MSC—22148-1—Apr. 1995, vol. 19, Issue 04, p. 82.

*Primary Examiner* — Quang D Thanh
(74) *Attorney, Agent, or Firm* — Eugene F. Friedman

(57) ABSTRACT

Manual CPR apparatus allowing the application of force at two points separated by a line making a nonperpendicular angle relative to the longitudinal axis of the patient. The line separating the two force points may also lie out of the plane formed by the device's belt which circumnavigates the patient's torso. These geometrical configurations allow the facile application of the CPR force to the device by one or more operators located along the side of the patient. The device may have the capability to limit the achieved circular chest compression to one of a plurality of magnitudes. The device may also provide signals to indicate the appropriate times for applying pressure and may incorporate electrocardiogram and defibrillation components. The device may contact the patient's chest with a suction cup or other adhering component to assist in the patient's chest expanding in the interval between compressive strokes.

26 Claims, 15 Drawing Sheets

(56) References Cited

U.S. PATENT DOCUMENTS

| | | | | | |
|---|---|---|---|---|---|
| 3,374,783 | A | | 3/1968 | Hurvitz | |
| 3,425,409 | A | | 2/1969 | Isaacson et al. | |
| 3,461,860 | A | | 8/1969 | Barkalow | |
| 3,481,327 | A | | 12/1969 | Drennen | |
| 3,491,751 | A | | 1/1970 | Wolfing | |
| 3,503,388 | A | | 3/1970 | Cook | |
| 3,777,744 | A | | 12/1973 | Fryfogle et al. | |
| 3,782,371 | A | | 1/1974 | Derouineau | |
| 4,059,099 | A | * | 11/1977 | Davis | 601/41 |
| 4,060,079 | A | | 11/1977 | Reinhold, Jr. | |
| 4,326,507 | A | | 4/1982 | Barkalow | |
| 4,338,924 | A | | 7/1982 | Bloom | |
| 4,397,306 | A | | 8/1983 | Weisfeldt et al. | |
| 4,424,806 | A | | 1/1984 | Newman et al. | |
| 4,770,164 | A | | 9/1988 | Lach et al. | |
| 4,928,674 | A | | 5/1990 | Halperin et al. | |
| 5,167,602 | A | | 12/1992 | Lehktman | |
| 5,287,846 | A | | 2/1994 | Capjon et al. | |
| 5,295,481 | A | * | 3/1994 | Geeham | 601/43 |
| 5,407,418 | A | | 4/1995 | Szpur | |
| 5,484,391 | A | | 1/1996 | Buckman, Jr. et al. | |
| 5,487,722 | A | * | 1/1996 | Weaver, II et al. | 601/41 |
| 5,490,820 | A | | 2/1996 | Schock et al. | |
| 5,645,522 | A | * | 7/1997 | Lurie et al. | 601/43 |
| 5,738,637 | A | * | 4/1998 | Kelly et al. | 601/41 |
| 6,676,613 | B2 | | 1/2004 | Cantrell et al. | |
| 2006/0047228 | A1 | * | 3/2006 | Petelenz et al. | 601/41 |

* cited by examiner

CROSS ACTION CHEST COMPRESSION APPARATUS FOR CARDIAC ARREST

CROSS REFERENCE TO RELATED APPLICATIONS

The present application claims the priority of the PCT application PCT/US2006/027518 filed on Jul. 14, 2006, which, in turn, claimed the priority of the filing of the U.S. provisional patent application 60/699,445 filed on Jul. 15, 2005, of which the present application also claims the priority.

BACKGROUND

K. A. Kelly et al., in their U.S. Pat. No. 5,738,637, issued Apr. 14, 1998, U.S. Pat. No. 6,234,984, issued May 22, 2001, U.S. Pat. No. 6,325,771, issued Dec. 4, 2001, and U.S. Pat. No. 6,645,163, issued Nov. 11, 2003, as well as their U.S. patent application Ser. No. 9/818,102, filed Mar. 27, 2001, and U.S. patent application Ser. No. 10/705,487, filed Nov. 11, 2003, have provided a remarkable manual device for effectuating CPR on a patient suffering cardiac arrest. The disclosures of these patents and applications are incorporated here by reference. The CPR device of Kelly et al. permits the quick, correct, facile and reliable, manual application of CPR to a person suffering cardiac arrest.

Prior concepts of CPR have focussed on two separate lines of thought. The first of these has instructed individuals to place their hands on the chest of the person in extremis and push down in a repeated cycle. This unassisted CPR suffers from several limitations. Foremost amongst these is the fact that very few individuals, even those supposedly trained in such CPR, can accomplish the task correctly to provide a significant improvement in the patient's chances of surviving the emergency. Further, this type of CPR has only succeeded in placing a force acting downward on the chest of the victim. While this may produce some desired blood flow, it entirely ignores the significant potential of increasing circulation by constricting the person's chest. Not surprisingly, this type of CPR has not proven particularly successful in saving lives of individuals suffering cardiac arrest.

The second type of CPR procedure does the opposite from the first: It circumvents the individual's chest with some sort of sleeve that then undergoes constriction to squeeze the chest and increase the desired blood flow as discussed above. A pneumatic sleeve with an air pressure device often powers this type of apparatus. However, this type of CPR typically fails to a provide downward force into the chest to achieve that assist to the circulation discussed with regards to manual CPR discussed above. Further, this type of apparatus typically requires a substantial financial investment and also necessitates significant training to assure its proper attachment to a patient and subsequent operation, even when "automated." Notwithstanding the foregoing, significantly improved examples of this type appear in U.S. Pat. No. 4,770,164 issued on Sep. 13, 1988, to R. Lach et al. as well as in the Kelly et al. patents and applications listed above. In fact, the latter show an automated apparatus accomplishing both types of CPR forces, downward and circumferential, discussed above.

Substantial interest has focussed on the ready use of defibrillation on persons suffering from cardiac arrest. While this process has a significant place in the treatment of such persons, it does not aid in bringing oxygen to the heart so that it can function upon defibrillation.

The manual CPR apparatus shown in the Kelly et al. patents and applications facilely accomplish both types of circulation assistance. It allows the downward force placed on it to pass directly into the chest of the patient to effectuate the radial force that directly depresses the chest. However, it also tightens a belt placed around the patient's chest to constrict it and the patient's chest to achieve further and important circulation around the heart muscle.

Significantly, the Kelly et al. device requires a minimal financial investment and virtually no training. This allows its placement in many and varied locations, such as the trunks of police squad cars and at gymnasiums and its use by individuals, such as the police themselves and others like coaches and other institutional personnel. In its simplest form, this CPR apparatus utilizes a belt placed around the victim and attached to a mechanism. When the operator pushes down on the handles forming part of this mechanism, some of the downward force passes straight through to the patient in the form of a radial force directed inward from his or her sternum into the chest. Significantly, the device converts part of the applied downward force into a tangential component that effects a circumferential tightening of the belt around the chest to squeeze it and further promote blood circulation around the heart.

While the Kelly et al. device described in its simplest form above has proven effective for persons with cardiac arrest, the patent and applications listed above disclose many additional features that may enhance its effectiveness in particular situations. Thus, the device may include a backboard to which the belt attaches or through slots in which the belt passes. The backboard may also have a raised portion for the patient's head, and the raised portion may house breathing apparatus and gas (such as oxygen) for the patient.

As other sophistications, the Kelly et al. device may include a force sensor to indicate the pressure applied to the victim's chest. An indicator of this force may then allow the operator to achieve more effective and safe treatment.

As a further safety feature, the apparatus may include a device for limiting the amount of circumferential tightening applied to the patient's chest. In particular, this feature may allow a choice between several different forces applied around the chest.

To assure full chest expansion between down strokes, Kelly et al.'s device may incorporate a component on its chest-contacting surface for adhering the device to the chest. Upon the release of pressure, this adherence will assist to expand the chest by pulling up on the patient's torso. This adhering device may take the form of suction cups or even some form of adhesive.

Kelly et al. also suggest a signal generator forming part of their device. This component has the purpose of producing a periodic signal. This signal simply informs the operator when to push down on the apparatus and helps achieve a rhythmic application of force at the interval that portends the greatest positive effect on the patient.

The apparatus may also include two or more electrodes, spaced apart from each other, that contact the patient's chest at different locations for the purposes discussed below. Two electrodes may attach to the base of the device which sits on the chest. Alternately, one may attach to the base while a second connects to the belt. Or, the two may attach at different locations along the longitudinal axis of the device's belt. Or, with more, the electrodes may attach to the belt and at several locations around the belt.

The electrodes may serve to obtain an electrocardiogram of the patient. Alternately or additionally, the electrode may defibrillate the heart when necessary.

As seen from the above, the Kelly et al. device has provided vastly improve CPR to individuals in dire need of such treatment. Naturally, the work continues to improve this mechanism even further.

SUMMARY

An improved apparatus for increasing the flow of blood in a patient will typically include a base contoured to seat near a central region of a patient's chest, an actuator, and a substantially inelastic belt means configured to wrap around the patient's chest substantially in a plane. A force converter then mounts on the base and couples to the actuator. This converter has belt connectors that couple to opposite extremities of the belt means with the belt means substantially in the plane described above. The converter serves to convert into belt tightening resultants applied to the belt connectors and directed substantially tangentially to the chest a force applied to the actuator at two separated points along a line making a nonzero angle to the plane of the belt means and directed toward the chest.

The Kelly et al. device carried two handles for the operator to apply a force to by pushing down on at separated locations for the CPR. The handles were separated by a line that actually lay in the plane defined by the belt. Stated in other words, the separation between the handles lies across the patient's chest, or, more accurately, perpendicular to the patient's longitudinal axis. This then requires the operator to straddle the patient or to try to configure his or her own body in an unnatural configuration to achieve the downward force on the two handles. The new device described above obviates this problem from the Kelly et al. device by moving the separation of the handles away from the plane of the belt that circumnavigates the patient's chest. This allows the operator to assume a more natural position along the side of the patient.

More particularly, the line separating the two handles may lie substantially perpendicular to the plane of the belt means. Stated alternately, the line separating the two handles, or the force points, lies substantially parallel to the longitudinal axis of the patient's torso. In either instance, the operator may facilely grab the handles to perform the life-saving function.

Rather than focussing upon the plane of the belt means that circumvents the patient, a description of an improved CPR device may focus on the points of attachment of the opposite extremities of the belt means to the belt connectors of the force converter. These two points generally define a first line. The converter then converts into belt tightening resultants applied to the belt connectors directed substantially tangentially to the chest a force applied to the actuator at two separated points along a second line making a nonzero angle to the first line and directed toward the chest. As suggested above, the preferred location of the second line along which the operator applies his or her force lies substantially perpendicular to the first line defined by the points of attachment of the opposite extremities of the belt means to the belt connectors of the converter. Or, the first line along which the operator applies the force lies substantially parallel to the longitudinal axis of the torso of said patient.

A method of CPR treating a patient, as indicated above, commences with seating a base of a blood flow increasing apparatus on a patient's chest near a central region of that chest. It then includes wrapping a belt means with first and second opposite extremities around the patient's chest, with the belt means itself substantially forming a plane. Any of the extremities of the belt means not already fastened to the apparatus are, accordingly, fastened to it, with the belt means substantially forming a plane. At this point, a force is applied at two separated points along a line making a nonzero angle with the plane defined above and directed toward the chest to an actuator coupled to a converter. The converter is, of course, coupled to the base and the belt means. Lastly, the force is converted into belt tightening resultants directed substantially tangentially to the chest.

Preferably, the line along which the force is applied lies substantially perpendicular to the plane defined by the belt means. Or, this line lies substantially parallel to the longitudinal axis of the patient's torso.

Alternately, the first and second extremities of the belt means are separated from each other substantially along a first line when fastened to the apparatus. A force is then applied toward the chest at two separated points along a second line making a nonzero angle relative to the first line and directed to an actuator coupled to a converter which in turn couples to the base and the belt means. Lastly, the force is converted into belt tightening resultants directed substantially tangentially to the chest. As above, the first line may lie substantially perpendicular to the second line, or alternately, substantially parallel to the longitudinal axis of the patient's torso.

DETAILED DESCRIPTION

Figure 1:
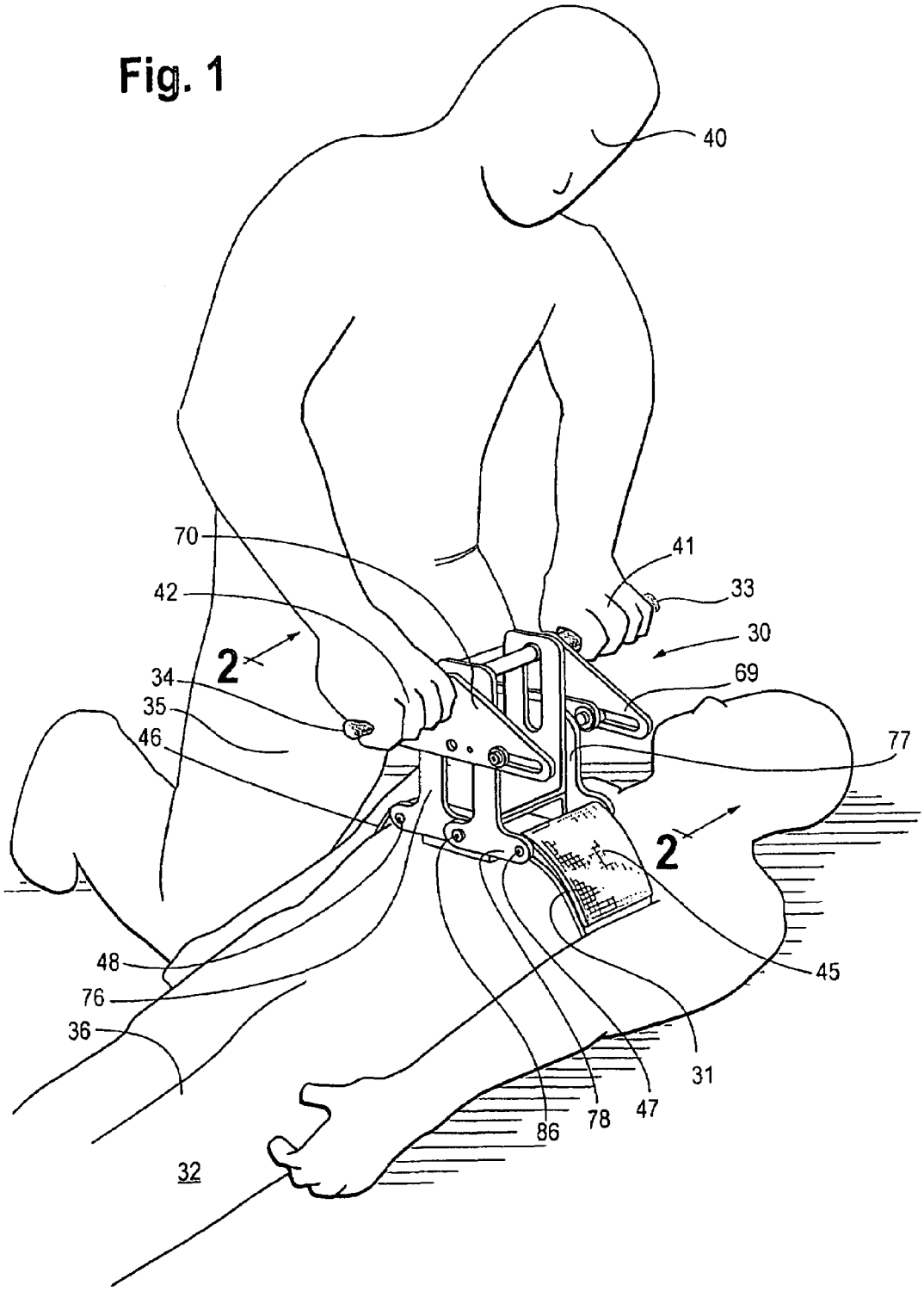
FIG. 1 shows an operator employing an improved device to administer CPR force from the side of a patient and along a line parallel to the patient's torso.
Figure 2:
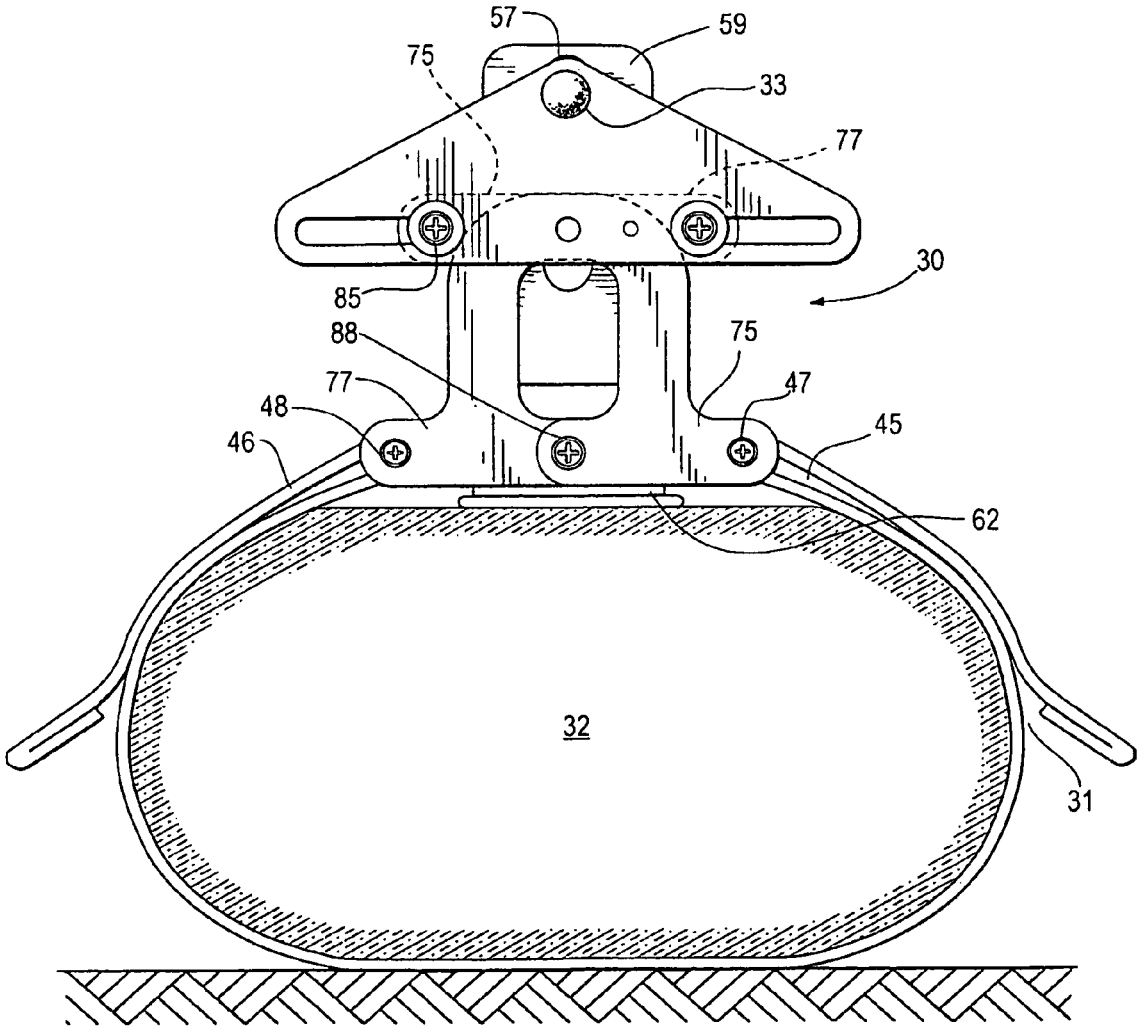
FIG. 2 gives an end view along the line 2-2 of the CPR device of FIG. 1 but without the operator.

FIGS. 1 to 7 show the CPR device generally at 30 attached by the belt 31 to the patient 32 undergoing CPR treatment. As seen particularly in FIGS. 1 to 3 and 7, the belt 31 generally defines a plane as it circumvents the patient 32. The handles 33 and 34 of the CPR device 30 lie (and are separated from each other) along the line 35. The line 35, in turn, generally forms a perpendicular angle with the plane of the belt 31. It also lies generally parallel to the longitudinal axis 36 of the patient 32.

This orientation of the handles 33 and 34 allows the operator 40 to kneel or otherwise position himself or herself along the side of the patient 32 and facilely place his or her hands 41 and 42 on the handles 33 and 34, respectively, to effectuate CPR. The operator 40 need not straddle the patient 32 or assume some other inconvenient or less effective position.

Figure 13:
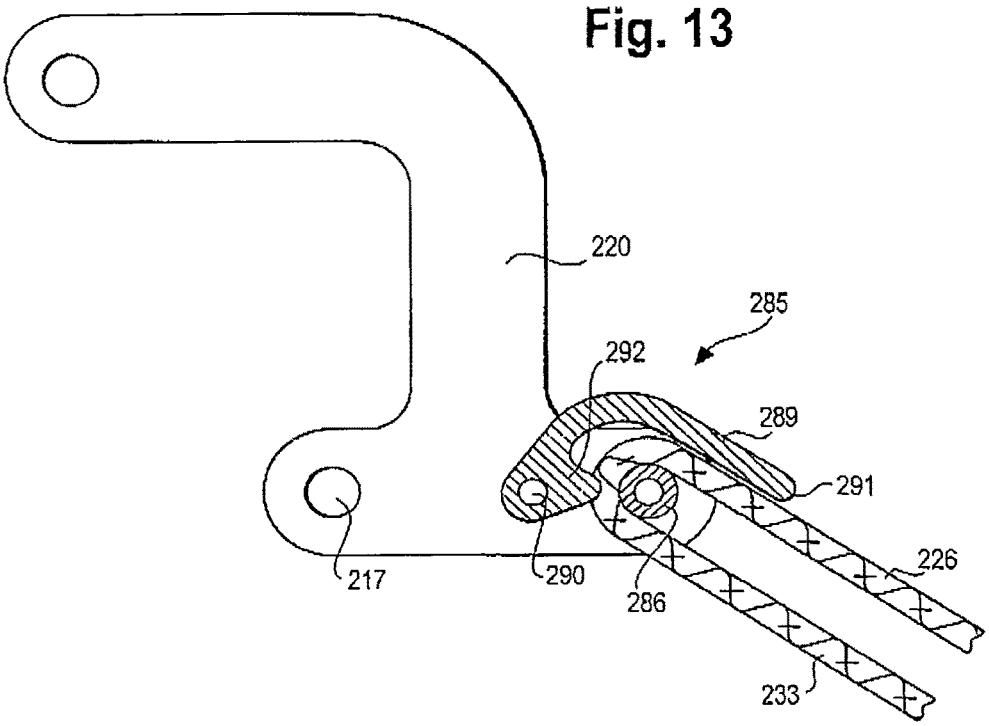
FIG. 13 has an enlarged view along the line 13-13 of the belt attaching mechanism of the CPR apparatus of FIG. 10.

To administer CPR, the operator 40 places the belt 31 around the patient's back and the apparatus 30 on the patients' chest. He or she then attaches the belt ends 45 and 46 to the device 30. Specifically, the ends 45 and 46 wrap around the rods 47 and 48 and attach there using such standard couplings such as hooks and loops, any of the connections shown in Kelly et al.'s patents and applications, or the quick release clamp discussed below with regards specifically to FIG. 13. This produces the configuration shown in particular in FIGS. 1, 2, and 4.

The operator then pushes downward on the handles 33 and 34. This accomplishes two tasks. First, the device 30 transmits a downward force directly onto the sternum of the patient 32 to directly compress the chest. This provides the first component of the CPR.

Second, pushing down on the handles 33 and 34 forces their interconnecting bar 53 to descend, with its bearings 55 and 56, along the openings 57 and 58 in the sides 59 and 60, respectively, of the U-bar 61, permanently affixed to the base 62. The bar 53, in turn, surrounded by the bearings 65 and 66, passes through the openings 67 and 68 in the triangular side plates 69 and 70, respectively, as clearly seen in FIG. 5. Thus, pushing down on the handles 33 and 34 causes the bar 53 to force the side plates 69 and 70 to travel downwards as well.

The plates 69 and 70 moving up and down forces the levers 75 to 78 to rotate around their respective pivot points 81 to 84, respectively. To see this, the bolt 85 journals the pivot points 81 and 83 of the side plates 75 and 77, respectively, to the opening 89 in the base 62 while similarly the bolt 86 rotatingly connects the pivot points 82 and 84 to the base 62. In turn, the bolt 91 passes through the slot 93 in the side plate and journals to the upper arm 95 of the lever 75. With the bar 53 in its raised position, the bolt 85 sits towards the interior of the side plate 69 as particularly seen in FIGS. 2 and 4. Pushing down on the handles 33 and 34 forces the plate 69 to move in the same direction which, concomitantly, forces the bolt 91 to move downward and, at the same time, towards the outside of the slot 93. This forces the lever 75 to rotate in the counterclockwise direction in FIGS. 4 and 5, the upper arm 95 of the lever 75 to move downward, and the lower lever arm 97 to travel upward all around the pivot point 81 to the position seen in FIGS. 3, 6, and 7.

Exactly the same takes place with regards to the lever 76 which has its upper arm 102 slidingly affixed to the side plate 70 by the bolt 104 which passes through the slot 106 and moves along it. An exactly analogous analysis shows that pushing down on the handles 33 and 34 causes the lever 76 to rotate in the counterclockwise direction, in FIGS. 4 and 5, its upper arm 102 to descend, and its lower arm 108 to elevate. Thus, in summary, pushing down on the handles 33 and 34 forces the lower arms 97 and 108 of the levers 75 and 76, respectively, to raise. However, the bar 48, to which the end 45 of the belt 31 attaches, is itself connected to the lower lever arms 97 and 108. Thus, pushing down on the handles 33 and 34 raises the belt end 45 and tightens the belt 31.

Figure 3:
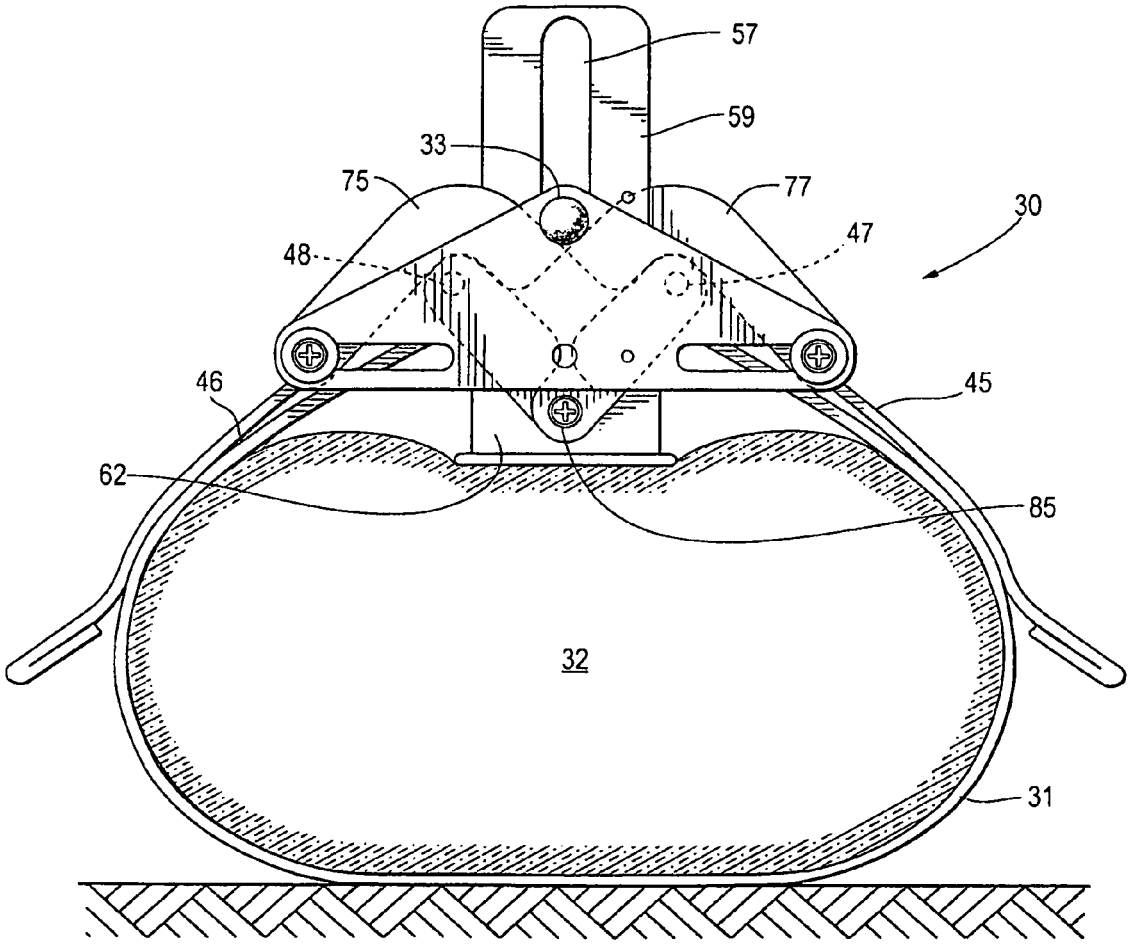
FIG. 3 provides a similar view of the CPR device of FIGS. 1 and 2 but with a downward force exerted on the device's handles.

Exactly the same thing happens to the other belt end 46. Pushing down on the handles 33 and 34 causes it to also raise and tighten the belt 31. As a consequence, a downward force on the handles 33 and 34 both depresses the chest of the patient and tightens the belt around it, as seen in FIGS. 3 and 7.

Figure 7:
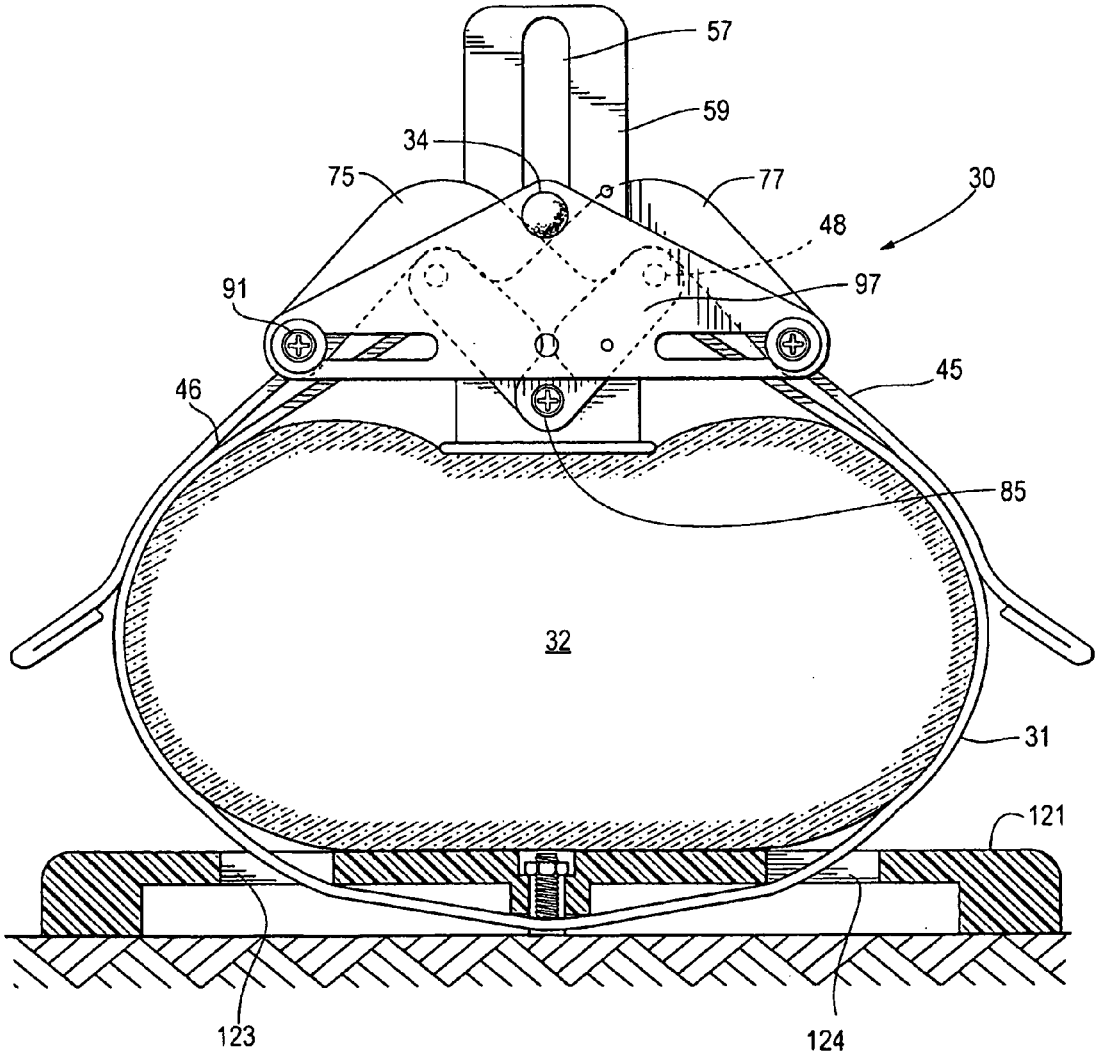
FIG. 7 illustrates a CPR device the same as that in FIGS. 1 to 6 with a view very similar to that in FIG. 3 but including the use of a backboard.

The latter FIG. 7 shows the use of the CPR device 30 on a patient 32 placed on the backboard 121. As seen there, the belt 31 passes through the two openings 123 and 124. To facilitate the use of the CPR apparatus 30, the backboard may permit the semipermanent attachment of the belt 31 for quicker use when needed. The backboard 121 may contain any or all of the features shown for such an item in the patents and applications of Kelly et al.

Figure 4:
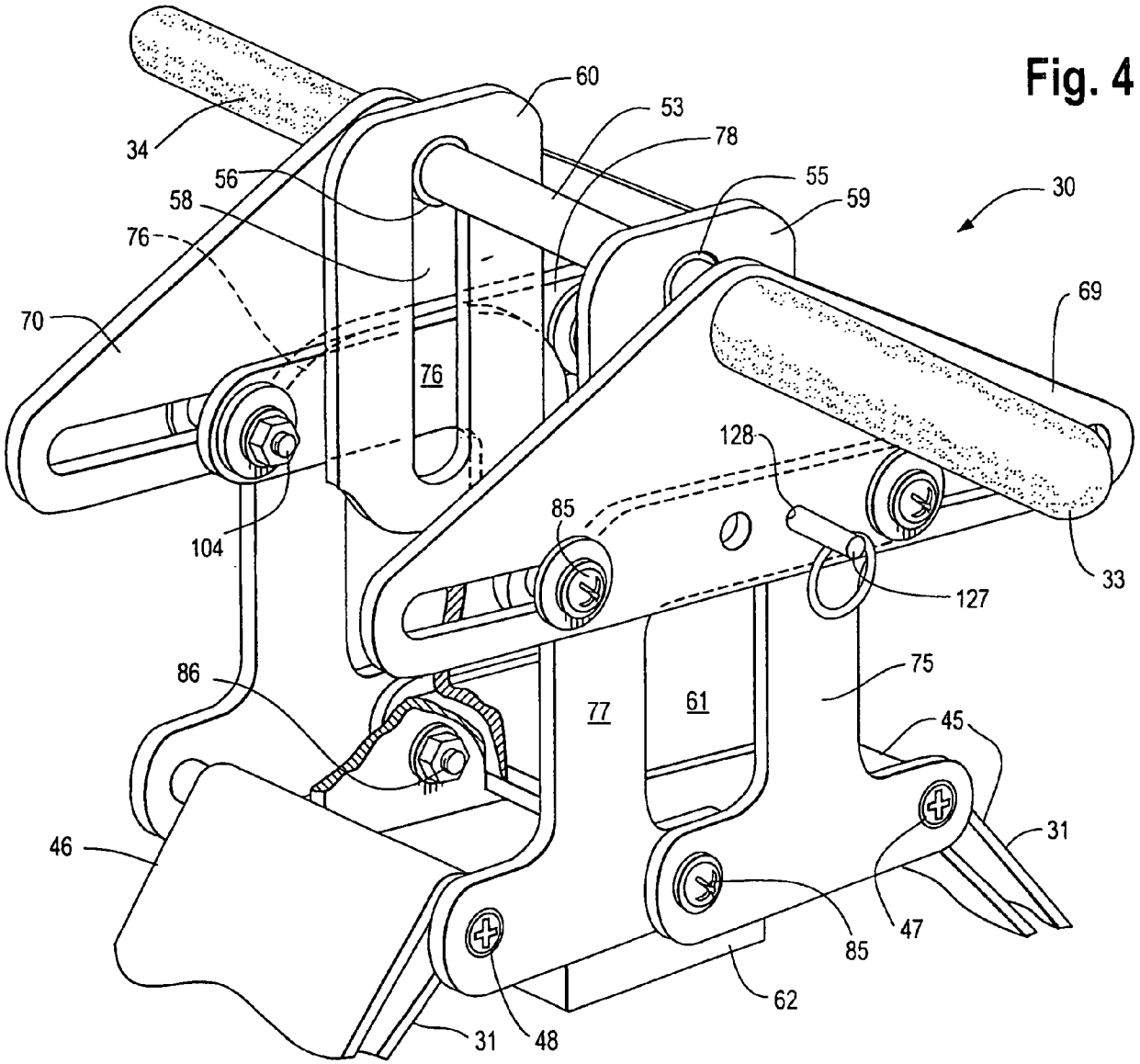
FIG. 4 shows an isometric view of the CPR apparatus of FIGS. 1 to 3.
Figure 5:
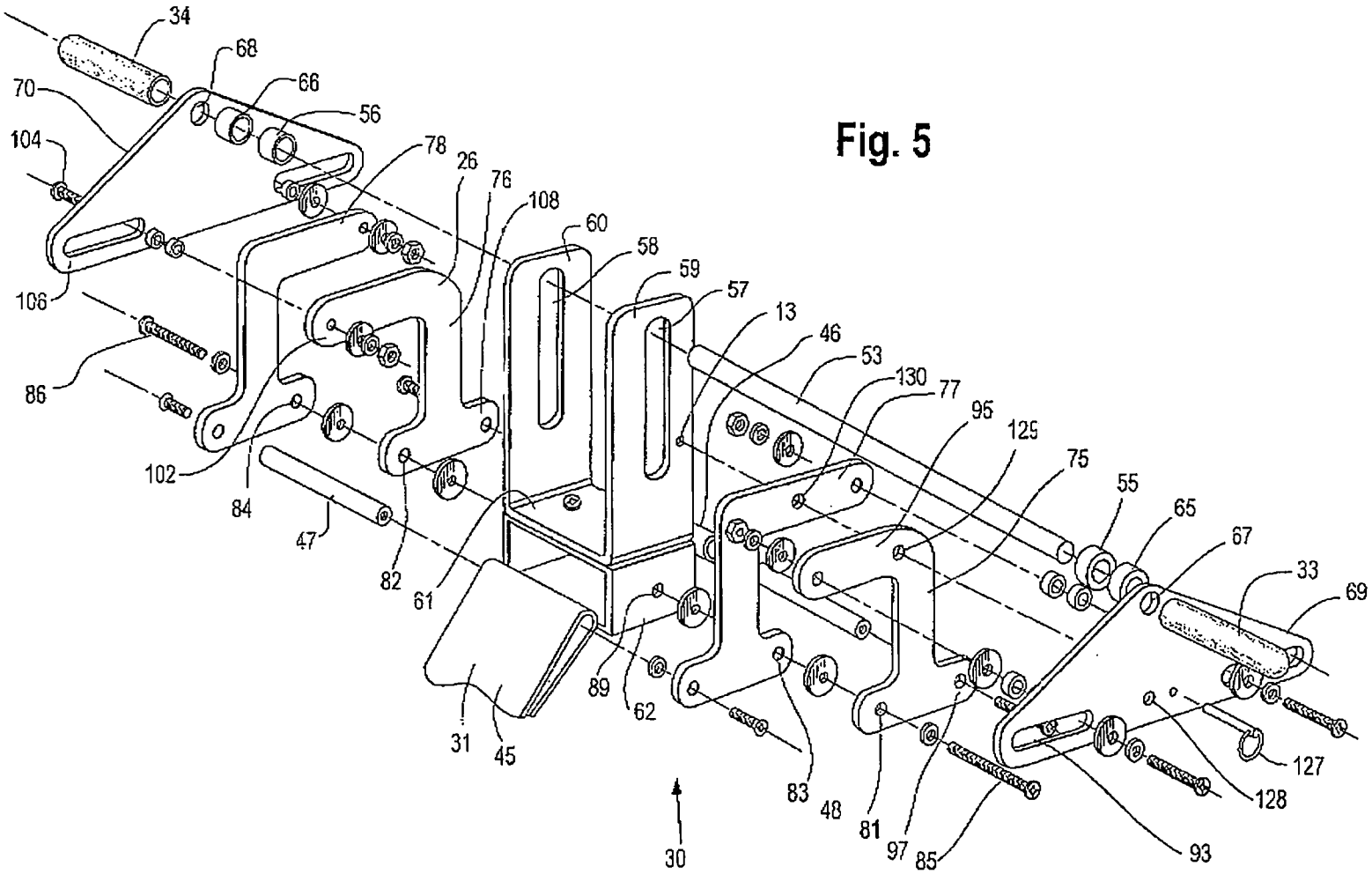
FIG. 5 displays the components of the CPR device of FIGS. 1 to 4 in exploded view.

Additionally, as seen in FIGS. 4 and 5, the lockpin 127 fits into the opening 128 of the side plate 69, and with the handles 33 and 34 in their raised position, the openings 129, 130, and 131 of the levers 75 and 77, and the U-bar 59, respectively. This keeps the device 30 in the elevated configuration shown in FIG. 4 to permit the taut attachment of the belt 31 immediately prior to use and prevent possibly deleterious movement when not in use.

As seen in the above figures, the levers 75 to 78 have the unique shape of T-bases with the upper arms bent 90 degrees to the horizontal (as seen there). This allows the upper arms to move to their descended positions seen in FIGS. 3, 6, and 7 without interfering the raising of the ends 47 and 48 holding the belt ends 45 and 46 to tighten the belt 31. In the tightened position seen in these figures, the bars 45 and 46 actually nestle in the 90 degree bends of the upper lever arms.

Figure 8:
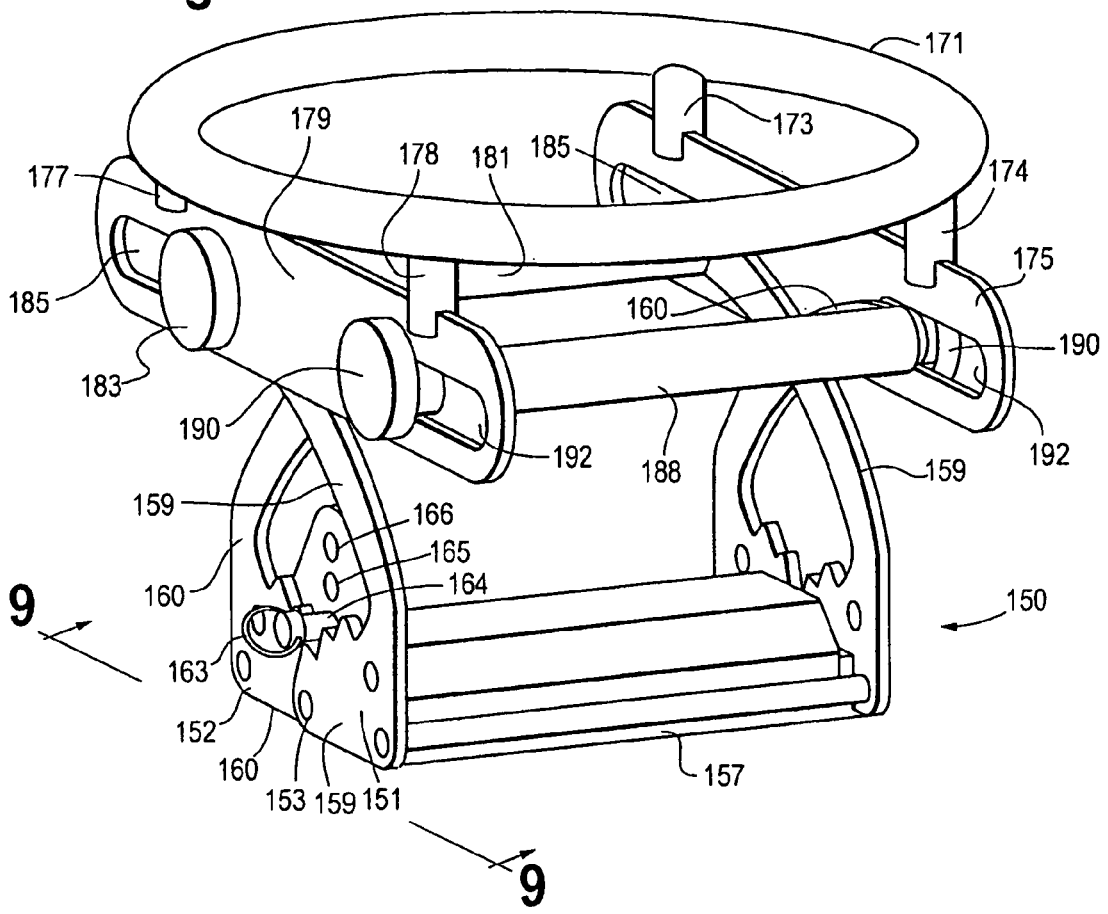
FIG. 8 shows, in an isometric view, a CPR device allowing the application of any of a number of preselected CPR forces somewhat similar to that seen in FIGS. 13 to 17 of the incorporated Kelly et al. patents and applications but permitting the location of the force at any two points around a circle relative the patient's torso.
Figure 9:
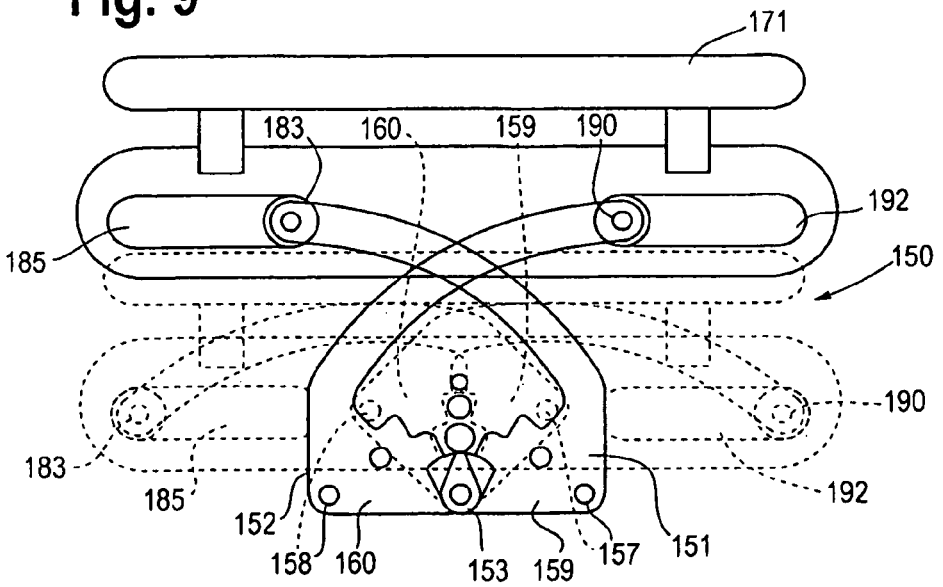
FIG. 9 gives an end elevational view along the line 9-9 of the CPR device shown in FIG. 8 with the compressive configuration in phantom.

FIGS. 8 and 9 show a CPR device generally at 150 built upon the unit shown in FIGS. 13 to 17 of the Kelly et al. patents and applications. Without repeating the analysis contained there, the device has the two over-center levers 151 and 152 that pivot about the point 153. The belt ends attach to the bars 157 and 158 connected to the respective lever arms 159 and 160 of the levers 151 and 152. As seen from the perspective of FIG. 9, the belt end from the right in the figure will attach to the bar 157 and the belt end from the left attaches to the bar 158. In turn, the lever arm 159 separates the bar 157 (and the right belt end) from the pivot point 153 and the lever arm 160 does the same action for the left-belt-end bar 158.

As the levers 151 and 152 pivot about the point 153, the bars 157 and 158 move upward and towards each other. This causes the ends of the belt attached to these bars to similarly move upwards and toward each other and tighten the belt about the torso of the CPR patient.

The stop pin 163 serves to limit the amount of rotation of the levers 151 and 152 about the pivot point 153. In particular, placing the pin 163 in the opening 164 permits the least amount of such rotation while placing it in the openings 165 and 166 allows ever increasing rotation and thus tightening of the belt about the patient's chest. Removing the pin 163 eliminates the barrier to rotation altogether should that prove necessary.

To operate the CPR device 150, the attendant pushes down on the wheel 171. The exact location where the operator places his or her hands does not matter to any particular degree. However, for balance, locating the pressure points on generally opposite sides of the wheel 171 would appear somewhat desirable. In particular, the wheel 171 permits placing the hands at two locations separated by a line lying generally parallel to the bars 157 and 158. However, these bars 157 and 158, with the belt surrounding the patient's chest and attached to them, lie generally parallel to the patient's longitudinal axis and also perpendicular to the plane defined by the belt circumnavigating the patient. The two posts 173 and 174 rigidly attach the wheel 171 to the side plate 175, and the posts 177 and 178 connect it to the plate 179. Thus, the operator's pushing down on the wheel causes the side plates 175 and 179 to descend. It also causes a downward pressure on the patient's chest.

As the side plates 175 and 179 descend, they similarly cause the rod 181, coupled to the upper lever arms 159 by the caps 183 which also pass through the slots 185, to move downward. At the same time, the rod 188, coupled to the plates 175 and 179 by the caps 190 which pass through the slots 192, also goes down and takes with it the upper lever arms 160. Thus, pushing down on the wheel 171 at any points around its circumference causes the levers 151 and 152 to pivot about the point 153 which has the effect of pulling up on the belt ends by the 157 and 158 to tighten it circumferentially about the patient's chest. This action is in addition to the direct downward force exerted on the patient's chest discussed above.

Figure 10:
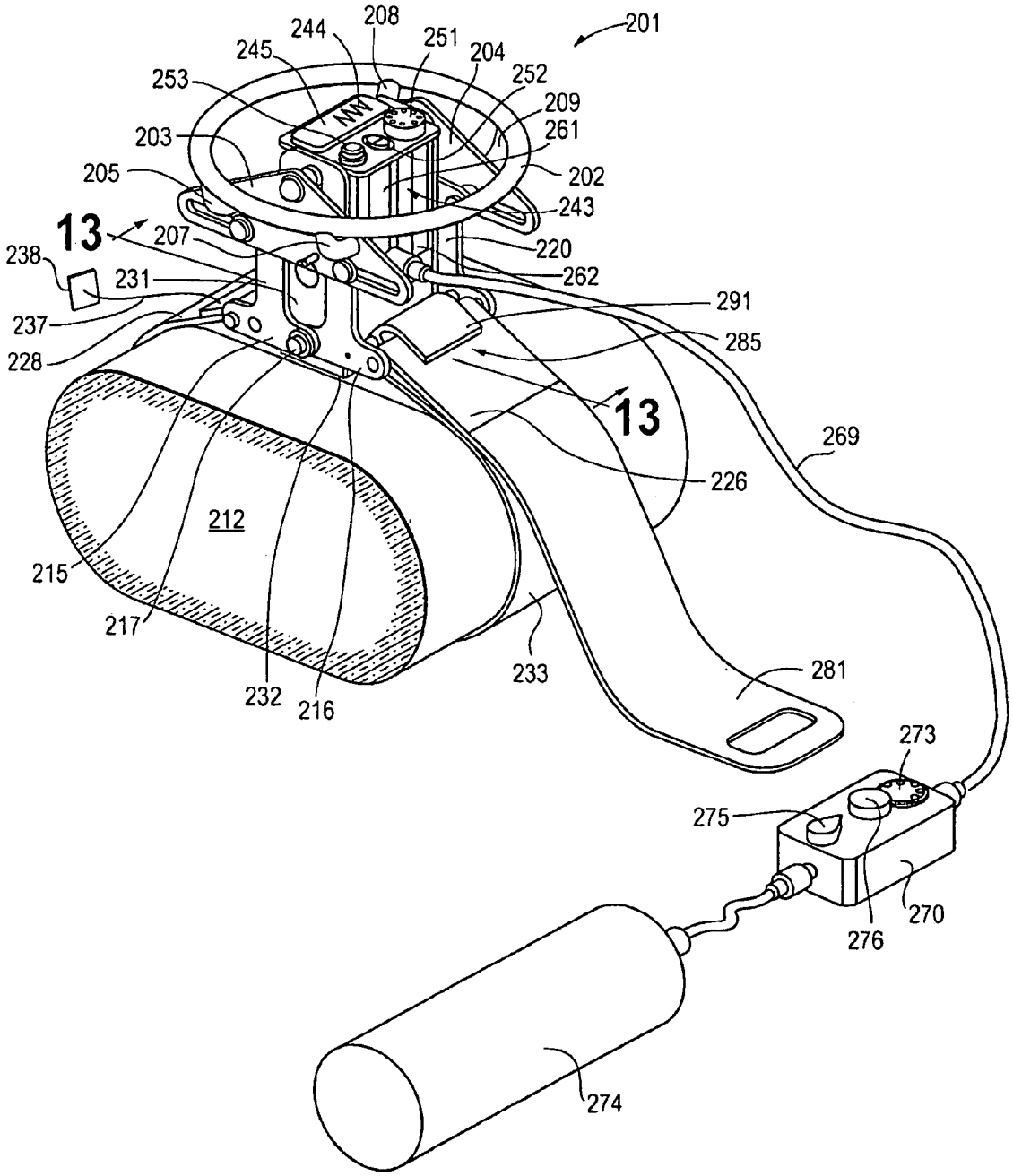
FIG. 10 provides an isometric view of a CPR apparatus utilizing a converting unit similar to that of FIGS. 1 to 7 but allowing the application of force at any two points around a circle over the patient's torso.
Figure 11:
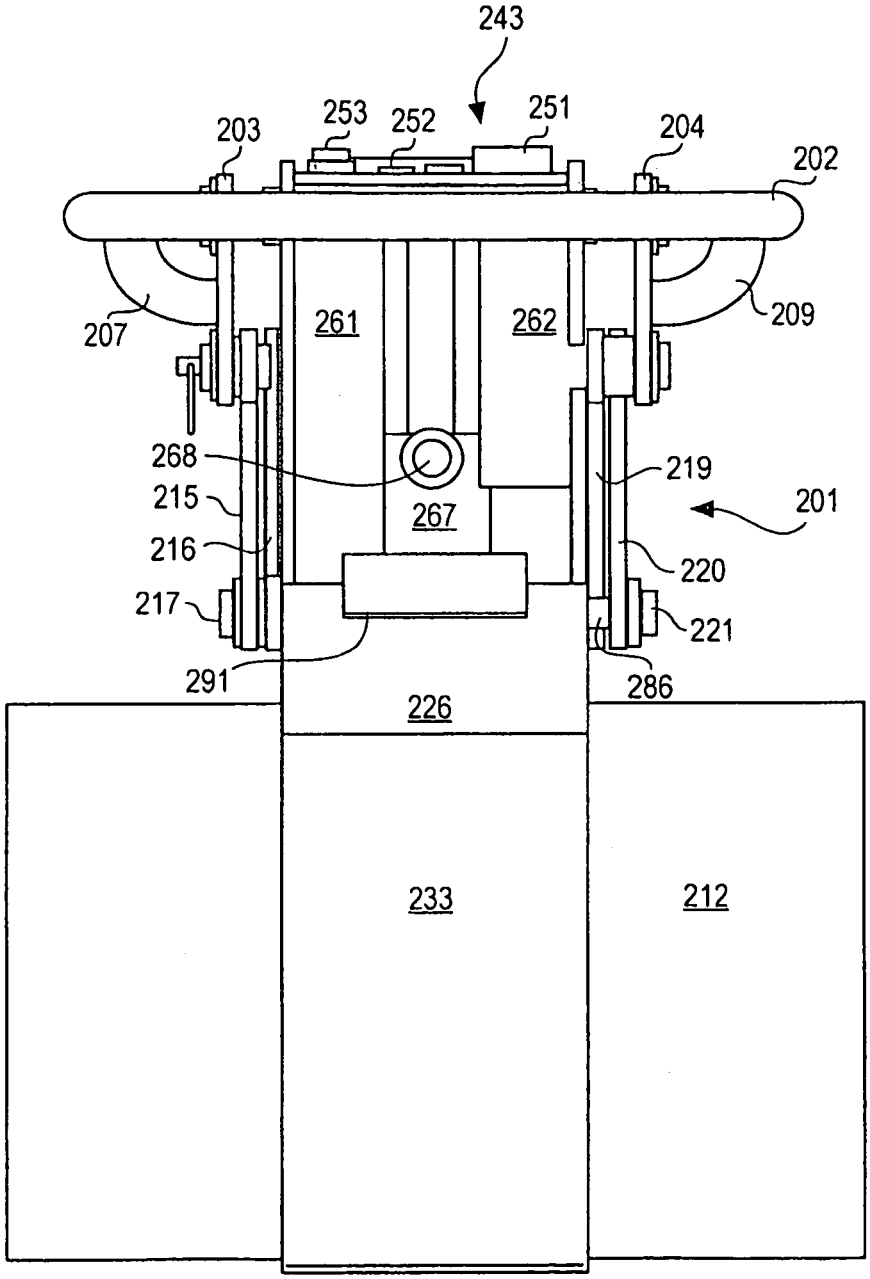
FIG. 11 portrays a side elevational view along the line 11-11 of the CPR device of FIG. 10.
Figure 12:
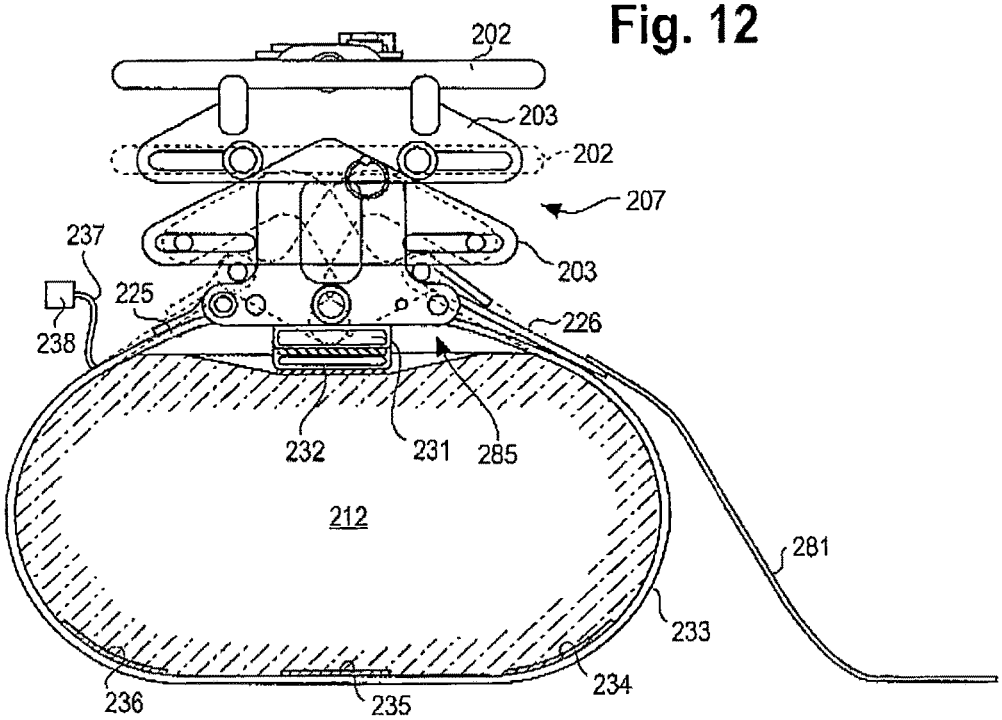
FIG. 12 gives an end elevational view along the line 12-12 of the CPR device of FIG. 10 and showing the compressive state in phantom.

FIGS. 10 to 12 show the CPR apparatus generally at 201 that operates in virtually the same manner as the device 30 in FIGS. 1 to 7 and includes a substantial number of important additional features. Initially, the manual operation of the apparatus 201 involves the attendant pushing down on the wheel 202. The wheel 202, in turn rigidly connects to the side plates 203 and 204 though the struts 205 to 208 and causes then to descend at the same time. As with the device 30 in FIG. 1, the downward motion of the side plates 203 and 204 first places a depressive force on the patient's chest 212. It also causes the levers 215 and 216 to rotate about their pivot point 217 and the levers 219 and 220 to rotate about their pivot point 221 to raise the belt ends 225 and 226 and circumferentially constrict the chest 212 in exactly the same fashion as the device 30 in FIGS. 1 to 7. The only difference in the two devices 30 and 201 in their mechanical operation is that the operator places his or her hands at most any generally opposed points on the wheel 202 in FIGS. 10 to 12 whereas the operator must grab the opposed handles 33 and 34 in FIGS. 1 to 7. This gives the device 201 an additional degree of flexibility not provided by the device 30.

However, the CPR device 201 of FIGS. 10 to 12 has numerous other features that enable it to perform its life-saving function in many different advantageous ways. Thus, as seen in FIGS. 10 and 12, the base 231 of the CPR device 201 includes the combined electrocardiogram ("EKG") and defibrillation ("defib") and possibly pressure sensitive pad 232. Similarly, the belt 233 incorporates the EKG-defib pads 234 to 236. The pads 232 and 234 to 236 have the usual functions indicated by the terms EKG and defibrillation. These pads couple to the wire 237 which may serve as an antenna or a quick connect and disconnect device through the plug 238. The wire may embed within the belt 233. The plug may allow for connection to an external computer or other device for monitoring the patient. It may also allow connection to a telephone or other device for transmission of its signals to other stations, and it may also indicate its own location.

Additionally, the CPR equipment 201 includes the electronic pack indicated generally at 243 that provides a variety of functions to aid in the task of saving a patient's life. First it may have the EKG display 244 which connects, in turn, to the pads 232 and 234 to 236. This provides a skilled operator with an indication of the patient's condition and progress. Next to the EKG display 244, the pack 243 may include the visual indicator 245 which tells the operator when to push down and complete a stroke. Most conveniently, the indicator 245 may take the form of a light that shines when it wishes for a CPR stroke.

The pack 243 also incorporates the display gauge 251 that indicates the pressure exerted by the operator's downward stroke. This informs the operator if he or she is providing adequate force to achieve effective CPR. The gauge receives its input from a pressure pad that may have a colocation with or form part of the EKG-defib pad 232.

The speaker 252 may provide an audible signal to indicate that a compression should occur. It could also provide verbal directions to facilitate the attachment and use of the CPR device 201 itself. Sitting next to the speaker 252, the on-off switch 253 controls the overall operation of the pack 243. As seen best in FIG. 11, the pack 243 also includes the computer 261 that controls the pack's other functions. It may also incorporate security features such as passwords or biometric measurements to identify the attendant and limit access to the operation of the pack 243. The computer 261 may also record and store information concerning the actuation of the equipment and the signals generated by it. In particular, the computer 261 can monitor the overall operation of the device and determine the most advantageous times to compress, ventilate or defibrillate the patient based in part on signals received from the pads 232 and 234 to 236. It can then operate the components that achieve these functions. The battery 262 then provides the power for the other components discussed above.

Additionally or separately, the pack 243 nay include the fluid piston or electrical motor 267 that can assist in the operation of the device 201 or operate it itself. It can receive its fluid or electrical power though the coupling 268 that connects to the electrical or fluid cable 269, as appropriate. The cable 269 then passes to the control assembly 270 which includes the gauge 273 which indicates the amount of pressure or electricity remaining in the tank or battery 274. The rotary switch 275 may turn the motor on and off and allow the selection of the frequency of the application of the CPR cycles. The selector switch 276 then permits a determination of the force to be applied to the patient. This may also work with feedback along the multichannel cable 269 to maintain the pressure at the preselected value.

Alternately, the tank 274 may simply hold oxygen that will travel along the cable 269 to the device 201 for delivery to the patient. The controller 270 in this instance includes the on-off and magnitude rotary switch 275, the pressure controller 276, and the gauge 273.

FIGS. 10 and 12 also show the detachable guide 281 that can releasably attach to the belt ends 225 and 226 of the belt 234. The guide 281 and each of the ends 225 and 226 may include a mechanism such as hooks and loops to attach them together. The guide 281 provides some stiffness to allow the belt ends 225 and 226 to be forced under the patient and fed into the device 201. It also provides some additional length for tightening the belt 233 around the patient's chest 212 should that prove necessary.

FIGS. 10 to 13 also show the clip generally at 285 for holding the belt 233 onto the bar 286. The Kelly et al. patents and applications suggest hooks and loops for this purpose. This type of connecting device may well perform with complete satisfaction for the anticipated uses of a CPR mechanism. However, the hooks and loops attachment may not prove acceptable under all conditions. Thus, it loses its effectiveness when wet or dirty. Moreover, it can wear out after extensive use.

The clip 285 avoids these limitations. It includes the curved metal latch 289 which can rotate about its journaled connection 290 to the levers 216 and 220. Inserting the belt into the clip first involves lifting the latch 289 by turning it in the counterclockwise direction in FIG. 13 and feeding the belt end 226 (possibly with the guide 281 attached) between it and the bar 286. Locking the belt 233 in place then proceeds by pressing the latch extension 291 in the clockwise direction in that figure. This forces the latch knob 292 to press against the belt 233 and hold it against the bar 286. Any force that would tend to pull the belt 233 out of the device actually causes the latch knob 292 to push the belt 233 harder against the bar 286 and, by squeezing the belt more tightly, keep it in place for the CPR. Releasing the belt 233 from the latch 285 merely involves lifting the latch end 291 with the fingers and moving it in the counterclockwise direction. This opens the space between the knob 292 and the bar 286 and permits the facile removal of the belt end 226.

Figure 6:
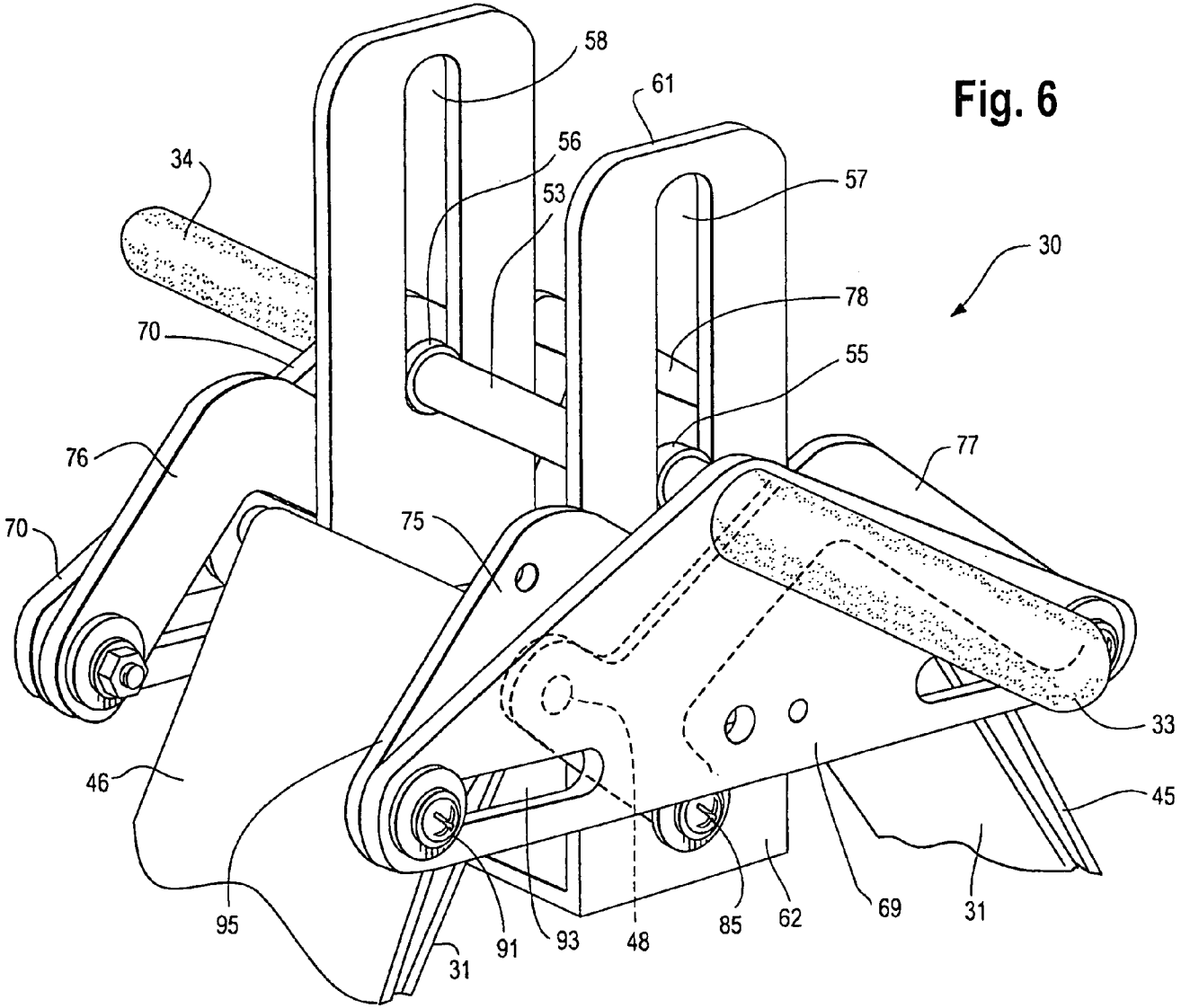
FIG. 6 gives an isometric view of the CPR apparatus of FIGS. 1 to 4 and very similar to that of FIG. 4 in particular but in a depressed, or compressive, state.
Figure 14:
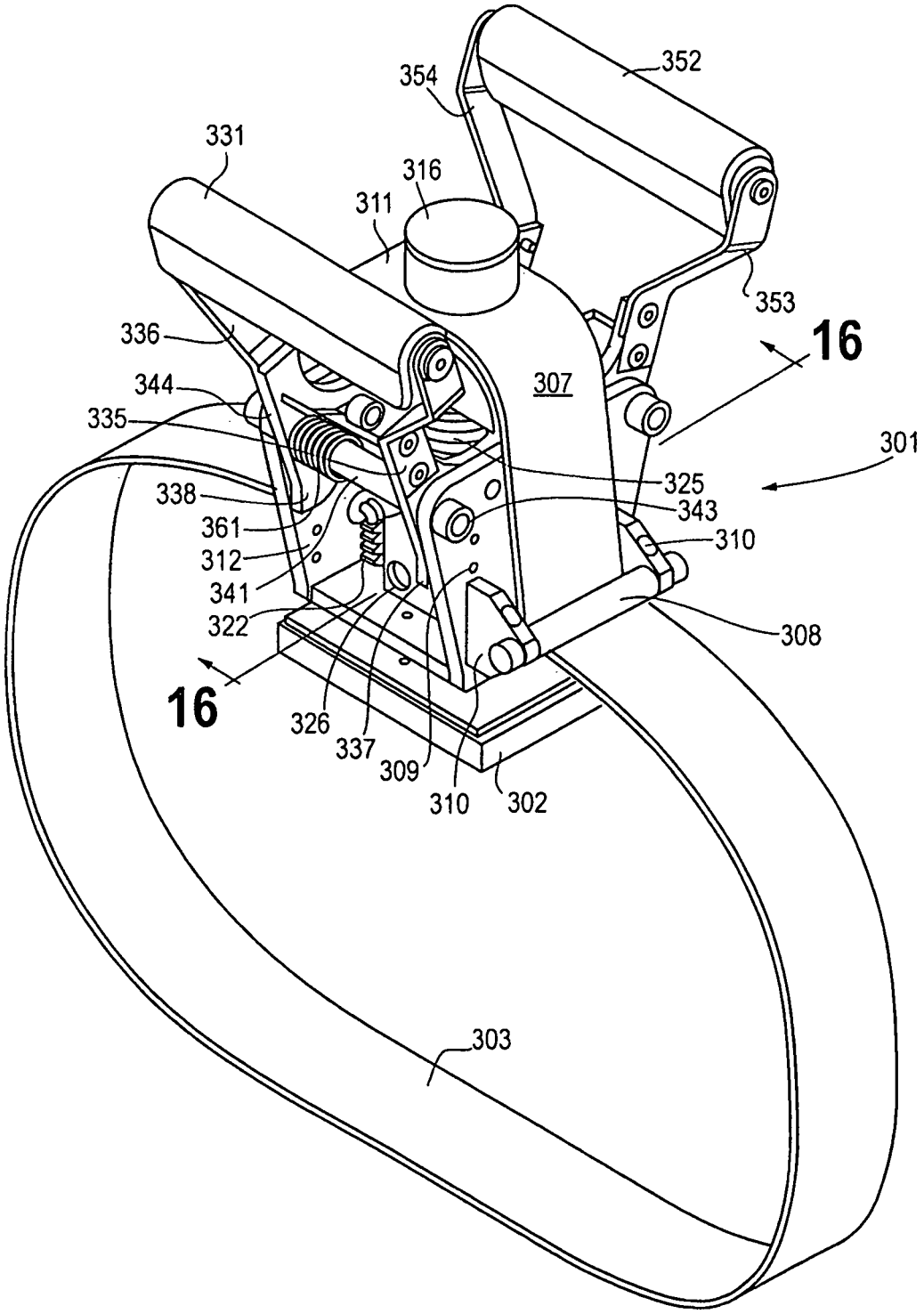
FIG. 14 provides an isometric view of an alternate CPR apparatus allowing the application of force along a line parallel to the patient's torso and in which the belt ends raise upward upon the application of a compressive force.
Figure 15:
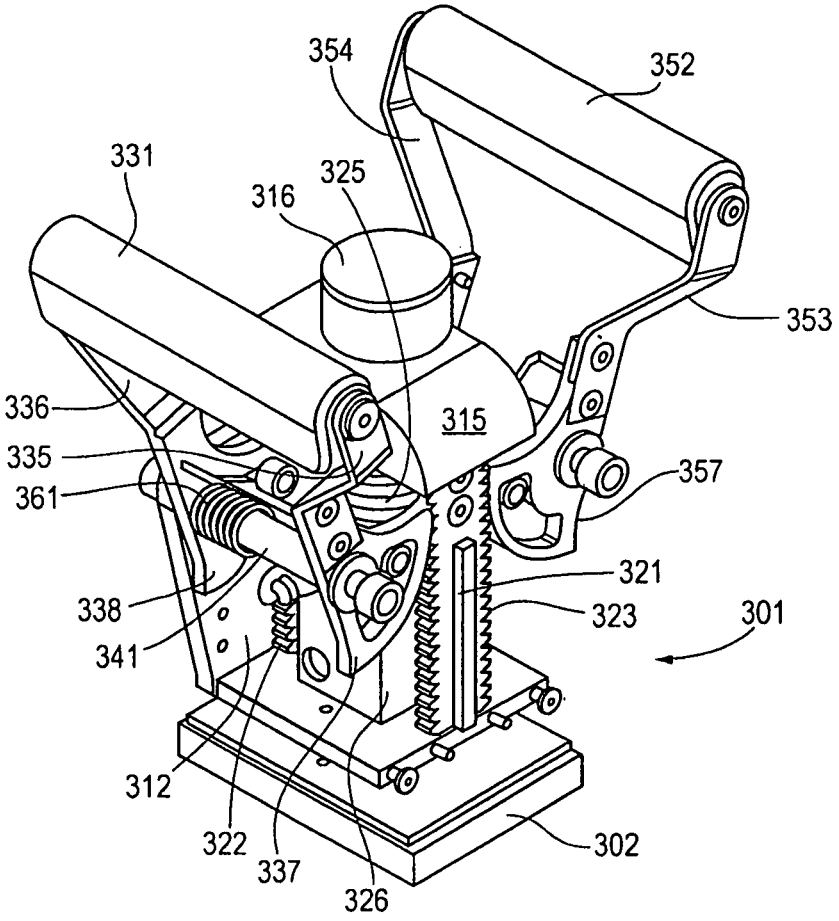
FIG. 15 has the same view of the same CPR apparatus of FIG. 14 but with the belt and one side removed to illustrate the working of that device's mechanism.
Figure 16:
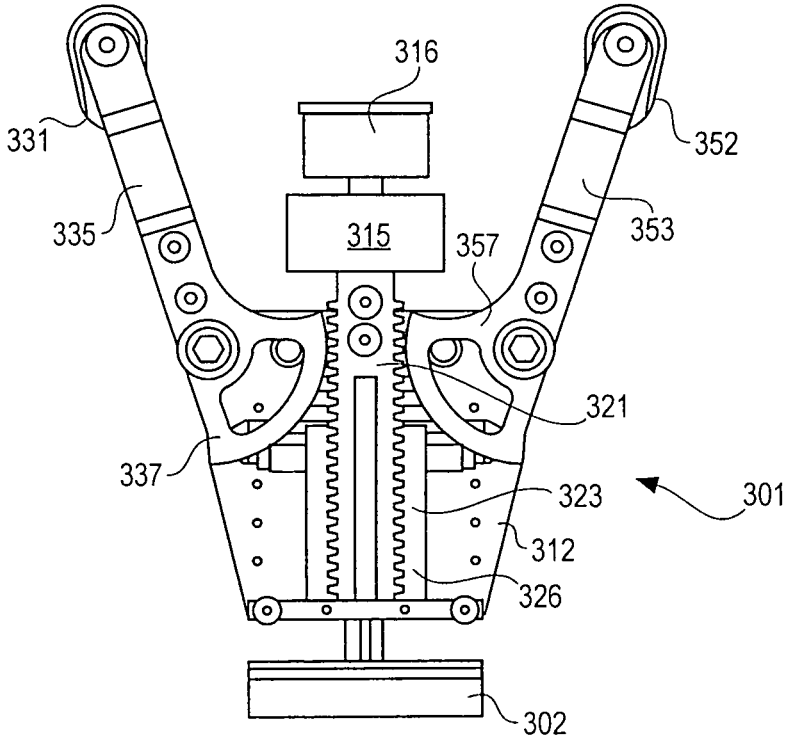
FIG. 16 gives a cross-sectional view along the line 16-16 of the CPR device of FIG. 14.

FIGS. 14 to 16 show the CPR device generally at 301 built on the principles shown in FIG. 6 of the Kelly et al. patents and applications. The base 302 sits upon the patient's chest, and the belt 303 circumnavigates the patient's thorax in the usual fashion. The belt end 307 passes under the rod 308 affixed to the side 309 by the tabs 310. Similarly, the other belt end 311 passes under a rod held by tabs (all not seen in the figure) to the side 312. The belt ends 307 and 311 pass onto the stage 315 (in FIGS. 15 and 16) where the cap 316 holds them securely in place with the belt snug around the patient's chest.

The stage 315 and the cap 316 attach to the two rack gears 321 and 322 which have the teeth 323 on both sides. The rack gears 321 and 322 and thus the stage 315 and the cap 316 remain free to move vertically relative to the base 302 and the sides 311 and 312. Furthermore, The platform 315 attaches to the post 325 which can also move vertically in the housing 326, which is also attached to the base 302. The insertion of the post 325 into the housing 326 guides the vertical motion of the stage 315. As the stage 315 moves upward, it also pulls the belt ends 307 and 311 in the same direction. This pulls the belt ends 307 and 311 through the rods (one of which appears in FIG. 14 and bears the number 308) and tightens the belt 303 around the patient's chest for CPR.

However, the vertical motion of the stage 315 and thus the tightening of the belt 303 fall ultimately under the control of the handles 331 and 332. The left handle (in the figures) 331 attaches to the two arms 335 and 336 which, in turn, connect to the two gear segments 337 and 338, respectively.

Pushing down on the handle 331 will cause the arms 335 and 336 and the gear segments 337 and 338 to rotate in the counterclockwise direction (in the figures) around the rod 341 attached to the sides 309 and 312 by the bolts 343 and 344, respectively. As the handle 331 and thus the gear segments 337 and 338 rotate in the counterclockwise direction, the teeth on the segments 337 engage the teeth 323 on the left side of the rack gears 321 and 322 causing them to move upwards. This takes the stage 315 and the belt ends 307 and 311 in the same direction which serves to tighten the belt 303 around the patient's chest for CPR.

Similarly, the handle 352 connects to the two arms 353 and 354. Pushing down on the handle 352 causes it to rotate in the clockwise direction and move its two gear segments (only the one of which labeled 357 appears in the figures) in the same direction. These, in turn, engage the right side of the rack gears 321 and 322 causing them to move upwards. This helps lift the state 315 and tighten the belt 303 around the patient's chest.

Thus, pushing down on the handles 331 and 352 accomplishes two tasks. First, it applies a downward force directly from the base 302 onto the patient's chest to depress it. Second, it tightens the belt 303 around the patient's chest to compress it. Both of these actions contribute to the desired CPR.

The spring 361 sits around the bar 341 and biases the handle 331 in the clockwise direction. If the operator releases the handle 331 after a CPR cycle, the spring 361 will move it back to the upright position seen in the figures. There it will wait for the next cycle.

Figure 17:
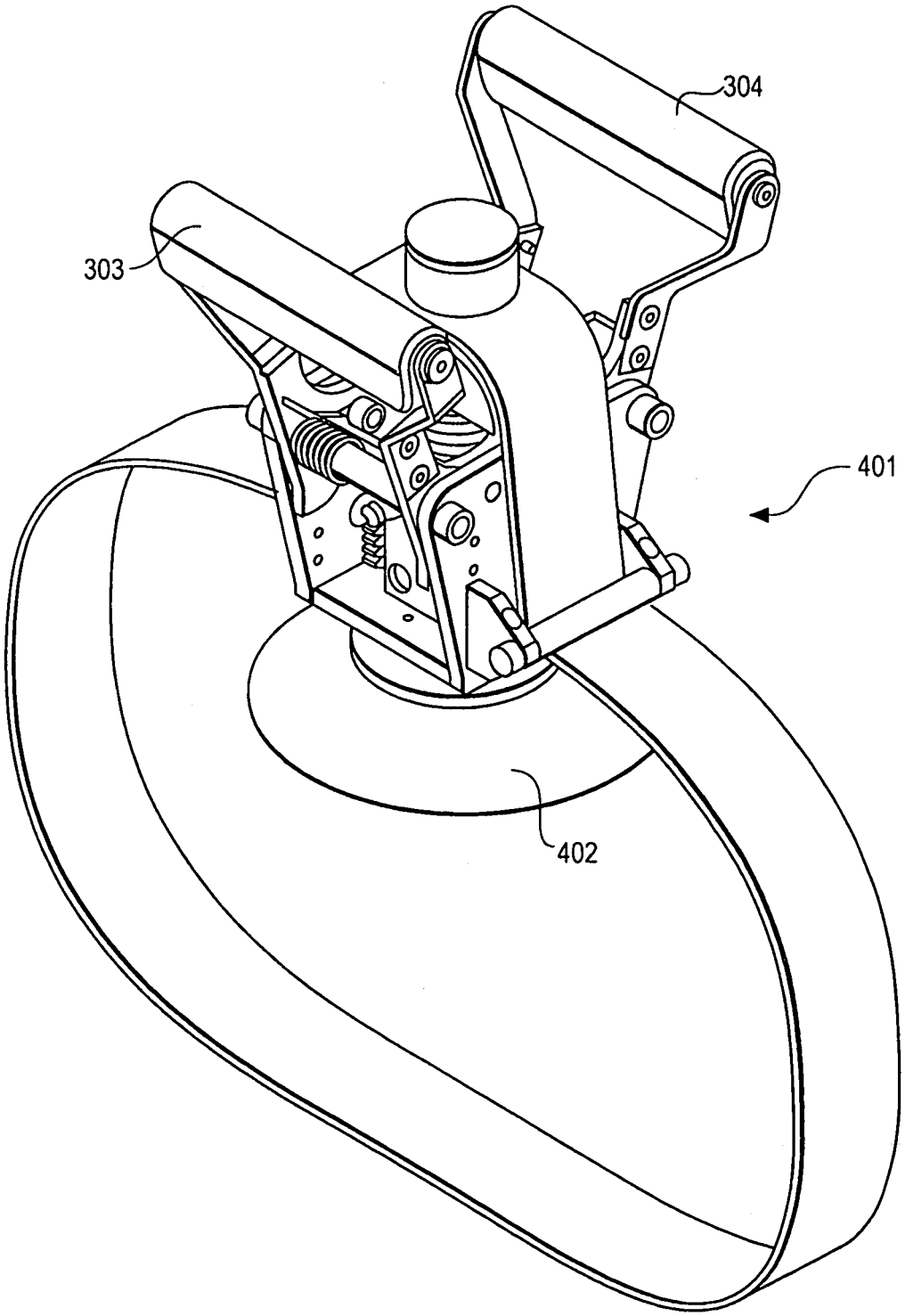
FIG. 17 portrays a CPR device virtually identical to that of FIGS. 14 to 16 except that it uses a suction cup to contact the patient's chest to assist in chest expansion between force applications.

FIG. 17 shows a CPR device generally at 401 identical to the unit 301 of FIGS. 14 to 16. However, it also includes the large suction cup 402 that sits on the patient's chest. Upon the completion of a CPR stroke (as discussed in reference to FIGS. 14 to 16), the operator can pull upwards on the handles 303 and 304. This will cause the suction cup 402 upward and pull the patient's chest in the same direction. This chest expansion assists in the blood flow around the heart and also facilitates the patient's obtaining air for breathing. Instead of the suction cup, the device 410 may have an adhesive on the bottom of its base to accomplish the same objectives.

Accordingly, what is claimed is:

1. An apparatus for increasing the flow of blood in a patient, the apparatus comprising:

(A) a base contoured to seat near a central region of a patient's chest;

(B) an actuator;

(C) a substantially inelastic belt configured to wrap around said patient's chest substantially in a plane; and (D) a force converter, mounted on said base, coupled to said actuator, and having belt connectors coupled to opposite extremities of said belt with said belt substantially in said plane, converting into belt tightening resultants applied to said belt connectors directed substantially tangentially to said chest a force manually applied to said actuator by a person placing two hands at two spatially separated points along a line making a nonzero angle to said plane and directed toward said chest, said force converter providing a substantially predefined, substantially linear path generally toward said chest for said two points to move along as said force is manually applied to said actuator at said two points.

2. The apparatus of claim 1 wherein said line is substantially perpendicular to said plane.

3. The apparatus of claim 1 wherein said patient has a torso with a longitudinal axis and wherein said line lies substantially parallel to said longitudinal axis of said torso of said patient.

4. The apparatus of claim 1 wherein said linear path is substantially straight.

5. The apparatus of claim 4 wherein said linear path is directed substantially towards the center of said chest.

6. The apparatus of claim 1 wherein said actuator includes an elongated, substantially rigid element connecting said two points, said force converter includes a generally elongated slot defining said substantially predefined, linear path, and said element moves in said slot as said force is applied to said actuator toward said chest.

7. The apparatus of claim 6 wherein said linear path is substantially straight.

8. The apparatus of claim 7 wherein said linear path is directed substantially towards the center of said chest.

9. An apparatus for increasing the flow of blood in a patient, the apparatus comprising:

(A) a base contoured to seat near a central region of a patient's chest;

(B) an actuator;

(C) a substantially inelastic belt means configured to wrap around said patient's chest; and (D) a force converter, mounted on said base, coupled to said actuator, and having belt connectors coupled to opposite extremities of said belt, said opposite extremities of said belt, when coupled to said converter, substantially forming a first line, for converting into belt tightening resultants applied to said belt connectors directed substantially tangentially to said chest a force manually applied to said actuator applied by a person placing two hands at two spatially separated points along a second line not substantially parallel to said first line and directed toward said chest, said force converter providing a substantially predefined, substantially linear path generally toward said chest for said two points to move along as said force is manually applied to said actuator at said two points.

10. The apparatus of claim 9 wherein said first line is substantially perpendicular to said second line.

11. The apparatus of claim 9 wherein said patient has a torso with a longitudinal axis and wherein said second line lies substantially parallel to said longitudinal axis of said torso of said patient.

12. The apparatus of claim 9 wherein said linear path is substantially straight.

13. The apparatus of claim 12 wherein said linear path is directed substantially towards the center of said chest.

14. The apparatus of claim 9 wherein said actuator includes an elongated, substantially rigid element connecting said two points, said force converter includes a generally elongated slot defining said substantially predefined, linear path, and said element moves in said slot as said force is applied to said actuator toward said chest.

15. The apparatus of claim 14 wherein said linear path is substantially straight.

16. The apparatus of claim 15 wherein said linear path is directed substantially towards the center of said chest.

17. A method of CPR treating a patient comprising:

(A) seating a base of a blood flow increasing apparatus on a patient's chest near a central region of said chest;

(B) wrapping a belt with first and second opposite extremities around said patient's chest, with said belt substantially forming a plane;

(C) fastening to said apparatus any of said extremities of said belt not already fastened to said apparatus, with said belt substantially forming a plane;

(D) manually applying by placing two hands at two spatially separated points along a line making a non-zero angle with said plane, a force, directed toward said chest, to an actuator coupled to a converter coupled to said base and said belt; and (E) converting said force into belt tightening resultants directed substantially tangentially to said chest, and (F) limiting the movement of of said two points to a substantially predefined, substantially linear path generally toward said chest as said force is manually applied to said actuator at said two points and directed toward said chest.

18. The method of claim 17 wherein said line is substantially perpendicular to said plane.

19. The method of claim 17 wherein said patient has a torso with a longitudinal axis and wherein said line lies substantially parallel to said longitudinal axis of said torso of said patient.

20. The method of claim 17 wherein said linear path is substantially straight.

21. The method of claim 20 wherein said linear path is directed substantially towards the center of said chest.

22. A method of CPR treating a patient comprising:

(A) seating a base of a blood flow increasing apparatus on a patient's chest near a central region of said chest;

(B) wrapping a belt with first and second opposite extremities around said patient's chest with said first and second extremities being separated from each other and substantially lying along a first line;

(C) fastening to said apparatus any of said extremities of said belt not already fastened to said apparatus with said first and second extremities substantially lying along said first line;

(D) manually applying a force, by placing two hands at two spatially separated points along a second line not substantially parallel to said first line and directed toward said chest, to an actuator coupled to a converter coupled to said base and said belt; and (E) converting said force into belt tightening resultants directed substantially tangentially to said chest; and (F) limiting the movement of of said two points to a substantially predefined, substantially linear path generally toward said chest as said force is manually applied to said actuator at said two points and directed toward said chest.

23. The method of claim 22 wherein said first line is substantially perpendicular to said second line.

24. The method of claim 22 wherein said patient has a torso with a longitudinal axis and wherein said second line lies substantially parallel to said longitudinal axis of said torso of said patient.

25. The method of claim 22 wherein said linear path is substantially straight.

26. The method of claim 25 wherein said linear path is directed substantially towards the center of said chest.

* * * * *